United States Patent [19]

Morrison

[11] Patent Number: 4,744,776

[45] Date of Patent: May 17, 1988

[54] PEDAL CRAFT

[76] Inventor: Ronald D. Morrison, 7786 Jasper Avenue, Edmonton, Alberta T5H 3R8, Canada

[21] Appl. No.: 869,017

[22] Filed: May 30, 1986

[51] Int. Cl.[4] ..... B63H 16/20

[52] U.S. Cl. ..... 440/29; 114/163; 440/53; 440/63

[58] Field of Search ..... 440/21, 26–31, 440/53, 63; 114/61, 162, 163, 166

[56] References Cited

U.S. PATENT DOCUMENTS 2,652,019 9/1953 Hurst ..... 440/63

FOREIGN PATENT DOCUMENTS 831040 8/1938 France ..... 440/27

975455 3/1951 France ..... 440/27

645306 9/1962 Italy ..... 440/31

*Primary Examiner*—Sherman D. Basinger

*Attorney, Agent, or Firm*—Sim & McBurney

[57] ABSTRACT

A water craft includes two parallel, spaced-apart pontoon hulls, and a superstructure bridging between the pontoon hulls. A propeller is operatively connected to foot pedals so that the propeller can be rotated to drive the craft. The propeller is supported between the two pontoon hulls, in such a way as to allow the propeller to shift laterally across the spacing between the pontoon hulls. Two rudders are provided aft of the propeller, and a steering arrangement simultaneously controls the angulation of the rudders and shifts the lateral position of the propeller toward the pontoon hull which would describe the outside arc for the turning maneuver in the desired direction.

14 Claims, 3 Drawing Sheets

PEDAL CRAFT

This invention relates generally to water craft constructions, and has to do particularly with the control aspect of a two-pontoon pedal craft in which the steering control of the craft is accomplished in a novel fashion.

BACKGROUND OF THIS INVENTION

One of the great difficulties in connection with double pontoon water craft relates to the steering of the same. The fact that two parallel pontoon-type hulls are utilized for buoyancy in such craft means that there is a very great tendency for the craft to remain pointed in a given direction, and considerable resistance to any steering or turning force. This is because the two pontoons act like twin keels, and tend to track in a straight line and to resist deviation from any original direction. It is often found, for example, that simply to supply rudder means aft of the twin pontoons is not sufficient to allow steering, particularly at slow speeds or when the craft is just getting under way. A rudder turned so as to be angulated with respect to the main direction of the pontoons will, when the craft is just starting forward, tend simply to be a drag in the water and will not allow the craft to get up sufficient speed to allow a turning action to take place.

In view of the above shortcoming of conventional constructions, it is an aspect of one embodiment of this invention to provide a water craft construction with an improved means of allowing turning and other steering maneuvers, particularly upon start-up or at slow speed.

GENERAL DESCRIPTION OF THIS INVENTION

Accordingly, this invention provides a water craft incorporating two parallel, spaced-apart pontoon hulls, and a superstructure bridging between the pontoon hulls. A propeller is provided, along with means for rotating the propeller to drive the craft. Further means support the propeller between the pontoon hulls in such a way as to allow the propeller to shift laterally across the spacing between the pontoon hulls. Rudder means are provided aft of the propeller, and steering means are provided to simultaneously control the angulation of the rudder means in order to promote turning of the craft in a desired direction, and to shift the lateral position of the propeller toward the pontoon hull which would describe the outside arc for the turning maneuver in the desired direction.

Further, this invention provides a water craft which incorporates two parallel, spaced-apart pontoon hulls, and a superstructure bridging between the pontoon hulls. A propeller is provided, along with means for rotating the propeller to drive the craft. Rudder means are provided aft of the propeller, and steering means control the rudder means. A horizontally extending sleeve is provided, and a propeller shaft slidably received in the sleeve, with the propeller being secured to the propeller shaft. An articulating drive shaft has one end operatively connected to the propeller shaft and the other end operatively connected to the pedal means, so that the user can operate the pedal means to rotate the propeller. The first means for rotating the propeller further includes a main drum and mechanical means whereby reciprocation of the pedal means causes rotation of the main drum, and a conical drum secured to the other end of the drive shaft. The conical drum is mounted such that its apex is directed toward said one end of the drive shaft. An endless belt is entrained around the main drum and the conical drum whereby rotation of the main drum requires rotation of the conical drum. Guide means are provided for the other end of the drive shaft, allowing the drive shaft, the conical drum and the propeller to shift in the fore-aft direction. Means are provided for biasing the drive shaft, the conical drum and a propeller toward the aft position, whereby as the propeller during rotation exerts a greater forward thrust on the propeller shaft, the conical drum will move forward, thus allowing the propeller to rotate faster for a given rotational rate of the main drum.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
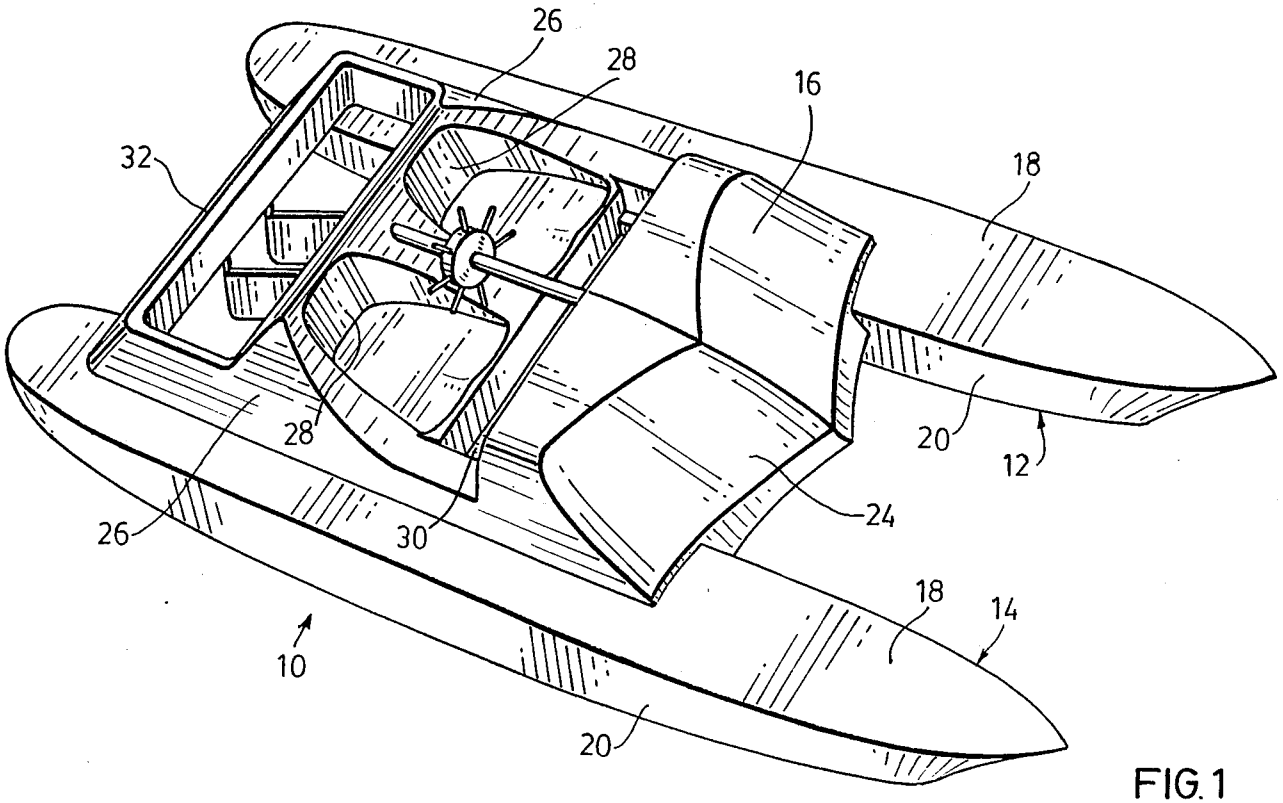
FIG. 1 is a perspective view of a water craft incorporating the present invention.
Figure 2:
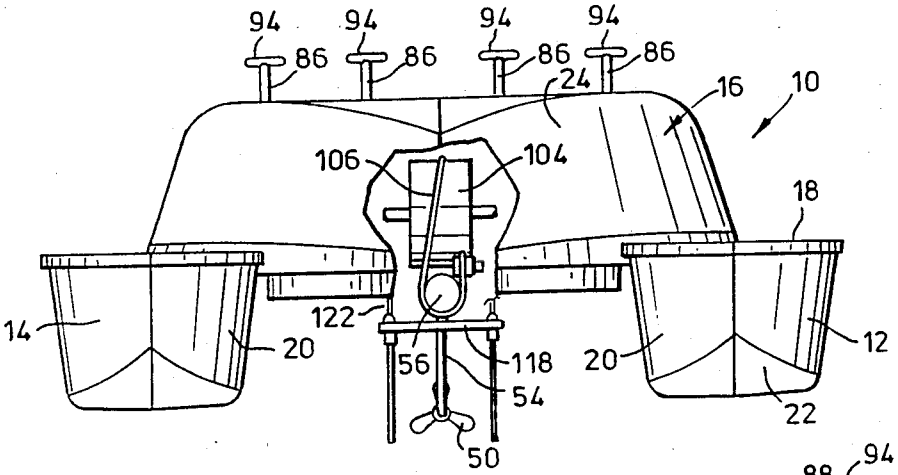
FIG. 2 is a front elevational view, partly broken away, of the water craft shown in FIG. 1.

The drawings illustrate a water craft 10 which incorporates two parallel, spaced apart pontoon hulls 12 and 14, and a superstructure 16 bridging between the pontoon hulls.

Each pontoon hull 12 and 14 has an upper wall 18, side walls 20, and a bottom wall 22.

The superstructure 16 defines a forward housing 24, rearwardly extending sidewalls 26, seat recesses 28 for two passengers, a floor 30, and a thwart member 32 extending between the two pontoon hulls 12 and 14 aft of the seat recesses 28.

Journalled in a forward bearing 34 and an aft bearing 36, both supported by the superstructure 16, is an angulated arm member 38 having a substantially horizontal upper portion 40 and a downwardly and rearwardly inclined rearward portion 42. The rear portion 42 terminates in a downwardly extending lower portion 44 which supports at its lowermost end a sleeve 46 through which extends a propeller shaft 48. The propeller shaft 48 thus extends in the fore-aft direction, and supports a propeller 50 at its rearward end. The propeller shaft 48 is longitudinally slidable within the sleeve 46, and the bearing contact is simply a metal on metal, water-lubricated contact of known type.

The forward end of the propeller shaft 48 is secured through a universal joint 52 to the aft end of a drive shaft 54, of which the forward end has secured to it a conical drum 56. The forward end of the drive shaft 54 is also journalled rotatably in a block 58 which is held between the two tines of a fork at the forward end of a guide shaft 62 which is slidable but not rotatable with respect to two brackets 64 and 66, the brackets extending upwardly from a plate 68 secured to the floor 30. Preferably, the guide shaft 62 is of rectangular section, as are the openings through the brackets 64 and 66, thus resisting rotation of the guide shaft 62. At the aft end, the guide shaft 62 undergoes an obtuse angled upward bend to define a control portion 68 ending in a knob 70.

The knob 70 is located where it can easily be grasped by a passenger sitting in one of the seats defined by the superstructure, and it will be appreciated that the propeller 50 can be moved forwardly by pushing forward on the knob 70, and rearwardly by pulling rearwardly on the knob 70. A tension helical spring 72 is connected between the forward bracket 64 and the block 58, thus biasing the drive shaft 54, the propeller shaft 48 and the propeller 50 to the furthest rearward position.

Secured under the top of the housing 24 is a horizontal cross member 74 from which forwardly project pairs of brackets 75 which pivotally support downwardly and forwardly depending foot pedals 76 having foot pads 78. The foot pedals 76 thus pivot about a horizontal axis defined by the connection between the brackets 75 and the upper ends of the respective foot pedals 76.

Figure 4:
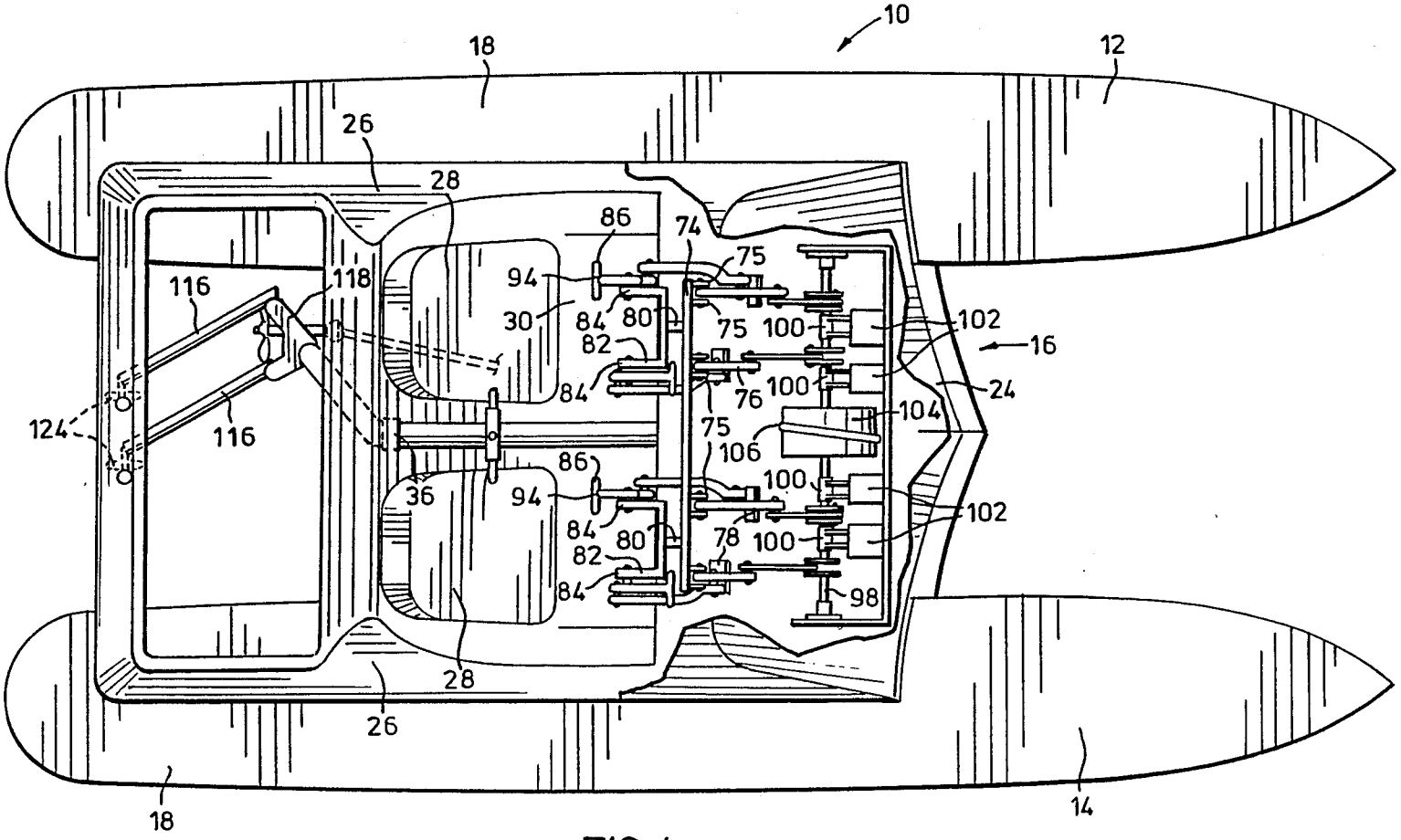
FIG. 4 is a plan view, partly broken away, of the water craft shown in FIG. 1.

Extending rearwardly from the cross member 74 are two support brackets 80, each of which support a C-shaped fork member 82, each fork member 82 having two rearwardly extending arms 84. Pivotally connected to each of the four arms 84 (see FIG. 4) is a hand lever 86, pivoted at 88, and having a downwardly projecting portion 90 pivotally connected by a connecting link 92 to a location on the foot pedal 76 spaced from the location of the brackets 75. It will be seen that a trapezoidal linkage is thus provided, such that swinging movement of the foot pedal 76 requires swinging movement of the hand lever 86. In the embodiment illustrated, each hand lever incorporates a T-shaped bar 94 at its upper end, for easy grasping.

Figure 3:
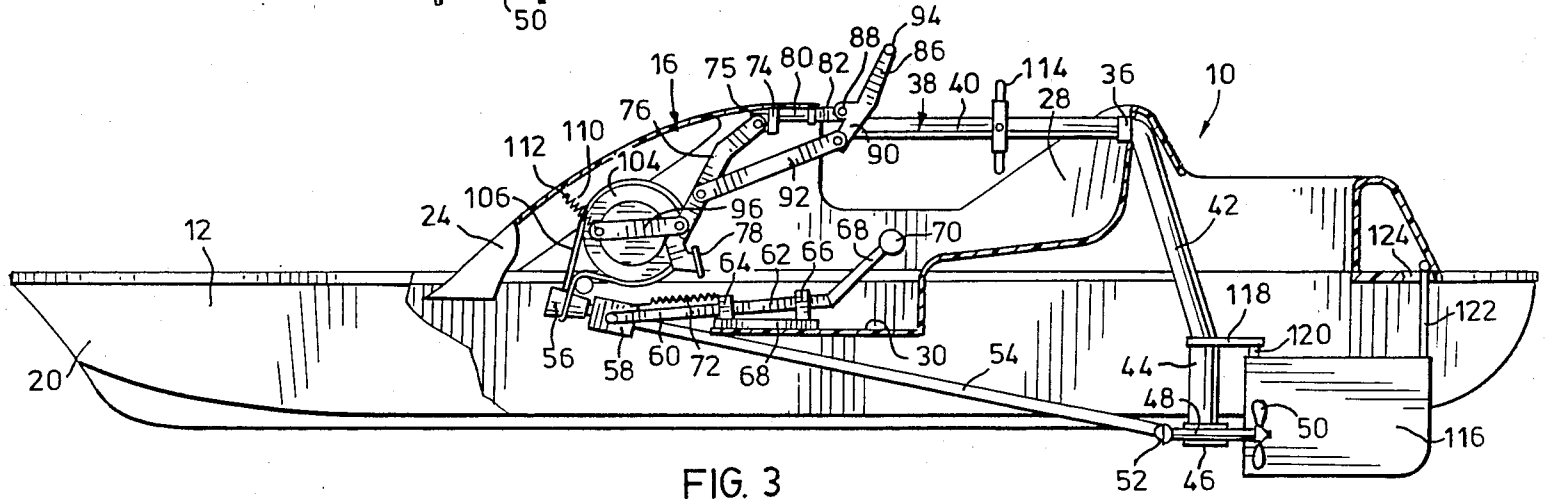
FIG. 3 is a side elevational view, also partly broken away, of the water craft shown in FIG. 1.

Connected to each foot pedal 76 at a location below the connection of the link 92 is a drive link 96 which is connected at its other end to a crankshaft 98 (see FIG. 4) in a manner similar to the crankshaft of an automobile. The crankshaft 98 is journalled in four bearings 100 which are supported by brackets from mounting plates 102 secured inside the housing 24. The crankshaft 98 centrally and concentrically supports a cylindrical drum 104 which is located adjacent the position of the conical drum 56. As can be seen particularly in FIG. 3, an endless belt 106 is entrained around both of the drums, and around a tensioning pulley 108 (FIG. 3) which is spring biased (by means not shown) in the upper forward direction.

A tension coil spring 110 is connected between a location 112 on the superstructure and the forward end of one of the drive links 96, at such an angle that it biases the crankshaft 98 to assume an at-rest position which is away from the top or bottom dead centre crank positions. This ensures that the passengers will always be able to initiate rotation of the propeller 50.

Turning now to the arm 38, it will be appreciated that the rotatable mounting in the bearings 34 and 36 allows the rearward portion 42 to swing about the axis of the upper portion 40, thus carrying the propeller 50 toward one pontoon or the other, depending upon the direction of swing.

A steering wheel 114 is provided, directly connected to the upper portion 40, for swinging the rearward portion 42 to one side or the other.

The swinging of the rearward portion is adapted to bring about the steering of two rudders 116, located generally aft of the propeller 50, and one to either side thereof.

To this end, there is provided just above the portion 44 of the rearward portion 42 a plate member 118, which supports the upper end of a short rod member 120 extending upwardly at the forward end of each rudder 116. The rod members 120 are secured in such a way that they rotate with respect to the plate member 118, but always remain in a parallel orientation with respect to the portion 44. This holds the rudders 116 in a constrained position with respect to the rearward portion 42, allowing only side to side swivelling of the rear end of each rudder 116. As particularly seen in FIGS. 3 and 4, each rudder 116 has, at its rearward end, a substantially vertical rod member 122, each rod member 122 extending upwardly through a separate fore-aft slot 124 defined in the superstructure 16. It will be appreciated that this effectively constrains the rearward edge of each rudder 116 to follow a fore-aft path with respect to the water craft, regardless of the position of the forward edge of the rudder. As the forward edges of the two rudders are carried to the left and to the right by the swinging of the arm member 38, the slots 124 allow the rod members 122 to move forward and aft as required.

It will thus be appreciated that the steering of the water craft involves not only the swivelling movement of the rudders 116, but also the positioning of the propeller 50 to one side or the other, depending upon the direction of steering. In order to turn to the right, for example, the propeller is moved toward the left pontoon hull, which automatically swings the rudders 116 in the direction necessary to accomplish the turn. By moving the propeller toward the leftward pontoon hull, the thrust on the water craft is displaced away from the central axis, thus further promoting the turning.

It will further be appreciated that the construction of the two drums 56 and 104 is such that, as the drive shaft 54 moves forwardly, thus also moving the propeller 50 and the conical drum 56 forwardly, the endless belt 106 moves toward the end of the conical drum 56 which is of smaller diameter, thus increasing the rotational speed of the drive shaft 54 for a given rotational speed of the cylindrical drum 104. This ensures that, as the propeller attains higher and higher speeds, corresponding to a greater forward thrust, the drive shaft 54 will move forwardly against the tension of the spring 72, thus bringing the endless belt 106 to a smaller-diameter location of the conical drum 56, thus decreasing the rate at which the pedals 76 have to be reciprocated in order to maintain the higher speed of the propeller 50.

It will further be noted that the direction along which the guide shaft 62 reciprocates forms an acute angle with the direction in which generally extends the drive shaft 54. This ensures that the conical drum 56 will move slightly away from the cylindrical drum 104 as the conical drum 56 moves forwardly, thus avoiding slack in the endless belt 106.

It is to be understood that a registry pin or the like could be provided on one of the brackets 64 and 66, adapted to register in one or more transverse bores at spaced locations along the guide shaft 62, thus allowing the guide shaft 62 to be fixed in one or a plurality of longitudinal positions, if desired.

While one embodiment of this invention has been illustrated in the accompanying drawings and described hereinabove, it will be evident to those skilled in the art that changes and modifications may be made therein without departing from the essence of this invention, as set forth in the appended claims.

THE EMBODIMENTS OF THE INVENTION IN WHICH AN EXCLUSIVE PROPERTY OR PRIVI-

LEGE IS CLAIMED ARE DEFINED AS FOLLOWS:

1. A water craft comprising:
two parallel, spaced-apart pontoon hulls,
a superstructure bridging between said pontoon hulls,
a propeller,
first means for rotating the propeller to drive the craft,
second means for supporting the propeller between the pontoon hulls, said second means allowing the propeller to shift laterally across the spacing between the pontoon hulls,
rudder means aft of the propeller,
and steering means adapted simultaneously (a) to control the angulation of the rudder means in order to promote turning of the craft in a desired direction, and (b) to shift the lateral position of the propeller toward the pontoon hull which would describe the outside arc for the turning maneuver in said desired direction.

2. The invention claimed in claim 1, in which said second means includes an arm member having an upper end pivoted to said superstructure and a lower end which includes a sleeve extending substantially horizontally, the propeller being secured to a propeller shaft received in said sleeve, the arm member being swingable between the pontoon hulls about the upper pivoted end, thereby to shift the propeller laterally of the water craft, said steering means including means for controlling the position of the arm member.

3. The invention claimed in claim 2, in which said arm member includes a portion which controls the angulation of the rudder means.

4. The invention claimed in claim 2, in which there are two rudders constituting said rudder means, the rudders being spaced apart in the direction perpendicular to the hulls, said arm member having third means fixed thereto, said third means being articulably connected to a forward portion of each rudder, each rudder having a rearward portion articulably connected to a location on said superstructure so as to be swingable about said location, the rudders being generally disposed on either side of the propeller, the two rearward portions of the rudders being substantially equidistant from a vertical plane midway between and parallel to the pontoons.

5. The invention claimed in claim 4, in which said location on said superstructure is configured to define two vertical fore-aft slots, each rudder having on said rearward portion thereof a substantially vertical rod member extending through one of said slots, whereby swinging movement of each rudder entails sliding movement of the respective rod member in the respective slot.

6. The invention claimed in claim 2, in which said first means comprises pedal means operable by the user of the water craft, and an articulating drive shaft having one end operatively connected to the propeller shaft and the other end operatively connected to the pedal means, whereby the user can operate the pedal means to rotate the propeller.

7. The invention claimed in claim 6, in which the propeller shaft is longitudinally slidable in the sleeve, said first means further including a main drum and mechanical means whereby reciprocation of the pedal means causes rotation of the main drum, and a conical drum secured to said other end of the drive shaft, the conical drum being mounted such that its apex is directed toward said one end of the drive shaft, an endless belt entrained around the main drum and the conical drum whereby rotation of the main drum requires rotation of the conical drum, and guide means for said other end of the drive shaft, the guide means permitting said other end to move rectilinearly along a line forming with respect to the axis of the drive shaft an angle substantially the same as the cone angle of the conical drum, whereby as the conical drum moves with respect to the main drum to bring the endless belt toward the end having the lesser diameter, the conical drum simultaneously moves away from the main drum, thereby avoiding a slack in the endless belt.

8. The invention claimed in claim 7, in which the drive shaft, the conical drum and the propeller are spring biased toward the aft position.

9. The invention claimed in claim 8, further comprising manual override means for positively fixing the fore-aft position of the drive shaft, the conical drum and the propeller.

10. The invention claimed in claim 6, in which said first means further comprises hand lever means operatively connected with said pedal means whereby the user of the water craft can employ both his arms and his legs to power the craft.

11. A water craft comprising:
two parallel, spaced-apart pontoon hulls,
a superstructure bridging between said pontoon hulls,
a propeller,
first means for rotating the propeller to drive the craft, said first means including pedal means,
rudder means aft of the propeller,
steering means adapted to control the rudder means,
a sleeve extending substantially horizontally, a propeller shaft slidably received in said sleeve, said propeller being secured to the propeller shaft,
and an articulating drive shaft having one end operatively connected to the propeller shaft and the other end operatively connected to the pedal means, whereby the user can operate the pedal means to rotate the propeller,
said first means further including a main drum and mechanical means whereby reciprocation of the pedal means causes rotation of the main drum, and a conical drum secured to said other end of the drive shaft, the conical drum being mounted such that its apex is directed toward said one end of the drive shaft, an endless belt entrained around the main drum and the conical drum whereby rotation of the main drum requires rotation of the conical drum, and guide means for the other end of the drive shaft allowing the drive shaft, the conical drum and the propeller to shift in the fore-aft direction, means for biasing the drive shaft, the conical drum and the propeller toward the aft position, whereby as the propeller during rotation exerts a greater forward thrust on the propeller shaft, the conical drum will move forward, thus allowing the propeller to rotate faster for a given rotational rate of the main drum.

12. The invention claimed in claim 11, in which said guide means permits said other end of the drive shaft to move rectilinearly along a line forming with respect to the axis of the drive shaft an angle substantially the same as the cone angle of the conical drum, whereby as the conical drive drum moves with respect to the main drum to bring the endless belt toward the end having the lesser diameter, the conical drum simultaneously moves away from the main drum, thereby avoiding slack in the endless belt.

13. The invention claimed in claim 11, in which the conical drum is disposed such that its axis is perpendicular to but spaced from the axis of the main drum.

14. The invention claimed in claim 13, further comprising manual override means for positively fixing the fore-aft position of the drive shaft, the conical drum and the propeller.

* * * * *